US008009134B2

(12) United States Patent
Mamba et al.

(10) Patent No.: US 8,009,134 B2
(45) Date of Patent: Aug. 30, 2011

(54) DISPLAY DEVICE

(75) Inventors: Norio Mamba, Kawasaki (JP); Toshiyuki Kumagai, Chigasaki (JP); Tsutomu Furuhashi, Yokohama (JP)

(73) Assignee: Hitachi Displays, Ltd., Chiba (JP)

( * ) Notice: Subject to any disclaimer, the term of this patent is extended or adjusted under 35 U.S.C. 154(b) by 770 days.

(21) Appl. No.: 12/124,197

(22) Filed: May 21, 2008

(65) Prior Publication Data

US 2008/0291339 A1 Nov. 27, 2008

(30) Foreign Application Priority Data

May 25, 2007 (JP) ..... 2007-139378

(51) Int. Cl.
*G09G 3/36* (2006.01)

(52) U.S. Cl. ..... 345/98; 345/100

(58) Field of Classification Search ..... 345/98, 345/100

See application file for complete search history.

(56) References Cited

U.S. PATENT DOCUMENTS 6,985,130 B2 * 1/2006 Nakayoshi et al. ..... 345/100
2006/0125986 A1 * 6/2006 Choo et al. ..... 349/114

FOREIGN PATENT DOCUMENTS

JP 2006-171729 6/2006

* cited by examiner

*Primary Examiner* — Kevin Nguyen
*Assistant Examiner* — Sepideh Ghafari
(74) *Attorney, Agent, or Firm* — Antonelli, Terry, Stout & Kraus, LLP.

(57) ABSTRACT

A data driver circuit is divided into a low potential region, an intermediate potential region, and a high potential region, and relative withstand voltages in the respective regions are set equal to each other. Both of the transmission of a power source voltage to the high potential region from the low potential region and the transmission of video signals are performed via the intermediate potential region. Due to such a constitution, the withstand voltages in the respective regions can be suppressed to low values.

9 Claims, 12 Drawing Sheets

DISPLAY DEVICE

CLAIM OF PRIORITY

The present application claims priority from Japanese application serial no. 2007-139378 filed on May 25, 2007, the content of which is hereby incorporated by reference into this application.

BACKGROUND OF THE INVENTION

1. Field of the Invention

The present invention relates to a TFT liquid crystal display constituting an active-matrix-type display device, and more particularly to a display device which can realize a display with little degradation of image quality with low power consumption and at a low cost.

2. Description of the Related Art

Currently, a TFT liquid crystal display (hereinafter, referred to as "LCD/") which constitutes an active-matrix-type display device has been popularly used as a display device of a personal digital assistant including a mobile phone due to characteristics thereof such as small thickness, high definition and low power consumption. In the LCD, by controlling turning on/off of thin film transistors (hereinafter, referred to as "TFT") mounted on respective liquid crystal pixels arranged in a matrix array in the horizontal as well as vertical direction in response to a gate voltage outputted from a gate driver, a data voltage outputted from a data driver is applied to liquid crystal thus controlling a transmissive/non-transmissive state of liquid crystal based on a potential difference between a common-line potential (Vcom) and the data voltage.

With respect to the characteristic of the liquid crystal, it has been known that the driving of the liquid crystal requires AC driving which inverts the polarity (potential level) of an applied voltage from the first polarity (positive polarity having a potential higher than the common-line potential (Vcom)) to the second polarity (negative polarity having a potential lower than the common-line potential (Vcom)) and from the second polarity to the first polarity at certain intervals.

As the AC driving of the liquid crystal in the LCD for the personal digital assistant, in general, the frame inversion driving which allows all liquid crystal pixels to have the same polarity and inverts the polarity of all liquid crystal pixels for every frame, and the line inversion driving which allows all liquid crystal pixels to have the same polarity in the horizontal direction, allows the polarity of the liquid crystal pixels to be inverted for every N lines in the vertical direction, and inverts the polarity of all liquid crystal pixels for every frame are used.

Further, the LCD for the personal data assistant adopts, in general, a driving method which reduces the power consumption by suppressing amplitude of a data line potential by combining the common inversion driving which simultaneously inverts the polarity of the common-line potential in addition to the inversion of the polarity of the data line potential with the above-mentioned driving. However, in the frame inversion driving and the line inversion driving, a considerable smear (a phenomenon which generates stripes in the horizontal as well as vertical direction) or considerable flickering (a phenomenon in which a screen flickers) is generated in the LCD thus degrading image quality.

To acquire a display with little degradation of image quality, AC driving of the liquid crystal by dot inversion driving which inverts the polarity for every liquid crystal pixel in both of horizontal and vertical directions, and also inverts the polarity of all liquid crystal pixels for every frame is effective. However, the dot inversion driving gives rise to new drawbacks such as a high withstand voltage of a driver LSI for driving the LCD or the increase of power consumption. On the other hand, particularly, with respect to a mobile phone, along with the increase of the number of users who make use of functions such as the reproduction of recorded motion images and a perusal of a Website using the mobile phone, there has been a demand for higher resolution of the LCD which can display large quantity of information at a time with high quality and hence, the realization of dot inversion driving with low power consumption and at a low cost is desired.

To cope with drawbacks which arise due to the above-mentioned dot inversion driving, particularly, to cope with the drawback in the power consumption, US Laid-open Patent 2006/0125986 (JP-A-2006-171729) proposes a driving method which realizes the low power consumption by arranging liquid crystal pixels connected to data lines in a LCD in a staggered manner such that the neighboring liquid crystal pixels are connected to different data lines and, at the same time, by dividing an output part of a driver LSI into an output part for first polarity and an output part for second polarity thus suppressing amplitude of a data line potential in the driver LSI to one half of amplitude of a corresponding data line potential in conventional dot inversion driving.

The related art can suppress the amplitude of the data line potential in the driver LSI. However, voltages of both polarities having first polarity and second polarity are applied to the data lines in the LCD and hence, a driver LSI output part is required to possess a high withstand voltage compared to conventional common inversion driving whereby there arise drawbacks such as the increase of a cost of the driver LSI or the increase of a circuit area and power consumption. In this manner, when the dot inversion driving is adopted for enhancing image quality of the LCD, there arises a drawback such as the increase of the cost or the increase of a circuit area to ensure the high withstand voltage of the driver LSI.

SUMMARY OF THE INVENTION

Accordingly, it is an object of the present invention to provide a display device which can realize dot inversion driving using a driver LSI having a low withstand voltage.

To overcome the above-mentioned drawbacks, in a driver LSI for driving an LCD of the present invention, particularly in a data driver, an output part is divided into an output part for first polarity and an output part for second polarity and, at the same time, liquid crystal pixels in the LCD are arranged in a staggered manner thus reducing amplitude of a data line potential at the time of performing dot inversion driving. Here, it is necessary to change over the polarity of the data line potential by a switch array for every 1 line. In such a changeover operation, by performing the forced transition of the data line potential to a Vcom potential before the polarity of the data line is inverted by short-circuiting a data line with a common line using the switch array once, a load applied to the output part of the data driver can be reduced. Accordingly, although the output part of the data driver conventionally requires the withstand voltage against the potential difference between the first polarity and the second polarity, the output part of the data driver of the present invention requires only a withstand voltage against a potential difference between the first polarity electrode and the Vcom and a potential difference between the second polarity electrode and the Vcom and hence, the present invention can realize the lowering of the withstand voltage.

On the other hand, in the data driver, a level of a video signal inputted from the outside is shifted to the first polarity or the second polarity, and the video signal is transmitted through a DA conversion circuit and hence, an analogue voltage applied to liquid crystal is generated in response to a digital video signal. Particularly, in a level shifter, an input video signal level is not shifted to a target potential level at a time. That is, the inside of the data driver is divided into three regions consisting of a region treating a potential of the first polarity, a region treating a potential of the second polarity and a region treating an intermediate potential, and the potential level is gradually shifted via the level shifters in the respective regions so that the lowering of withstand voltage of the level shifter can be realized. Further, with the use of a power source circuit incorporated in the data driver, power sources for first polarity and second polarity are generated by a booster circuit. Here, in the same manner as the input video signal, the voltage is gradually boosted via the booster circuits in the respective regions and hence, the lowering of the withstand voltage of the power source circuit can be realized.

In this manner, by realizing the lowering of the withstand voltage of the output part of the data driver, the level shifter in the data driver and the power source circuit along with the reduction of amplitude of the data line potential, it is possible to realize the lowering of the withstand voltage of the whole driver LSI.

According to the present invention, the dot inversion driving can be realized using the driver LSI of the low withstand voltage thus acquiring the reduction of cost and the reduction of power consumption of the driver LSI with little degradation of image quality. The present invention is applicable to a liquid crystal display device of a mobile phone, a personal digital assistant or the like.

DESCRIPTION OF THE PREFERRED EMBODIMENT

Embodiments of the present invention are explained in conjunction with drawings hereinafter.

Embodiment 1

Figure 1:
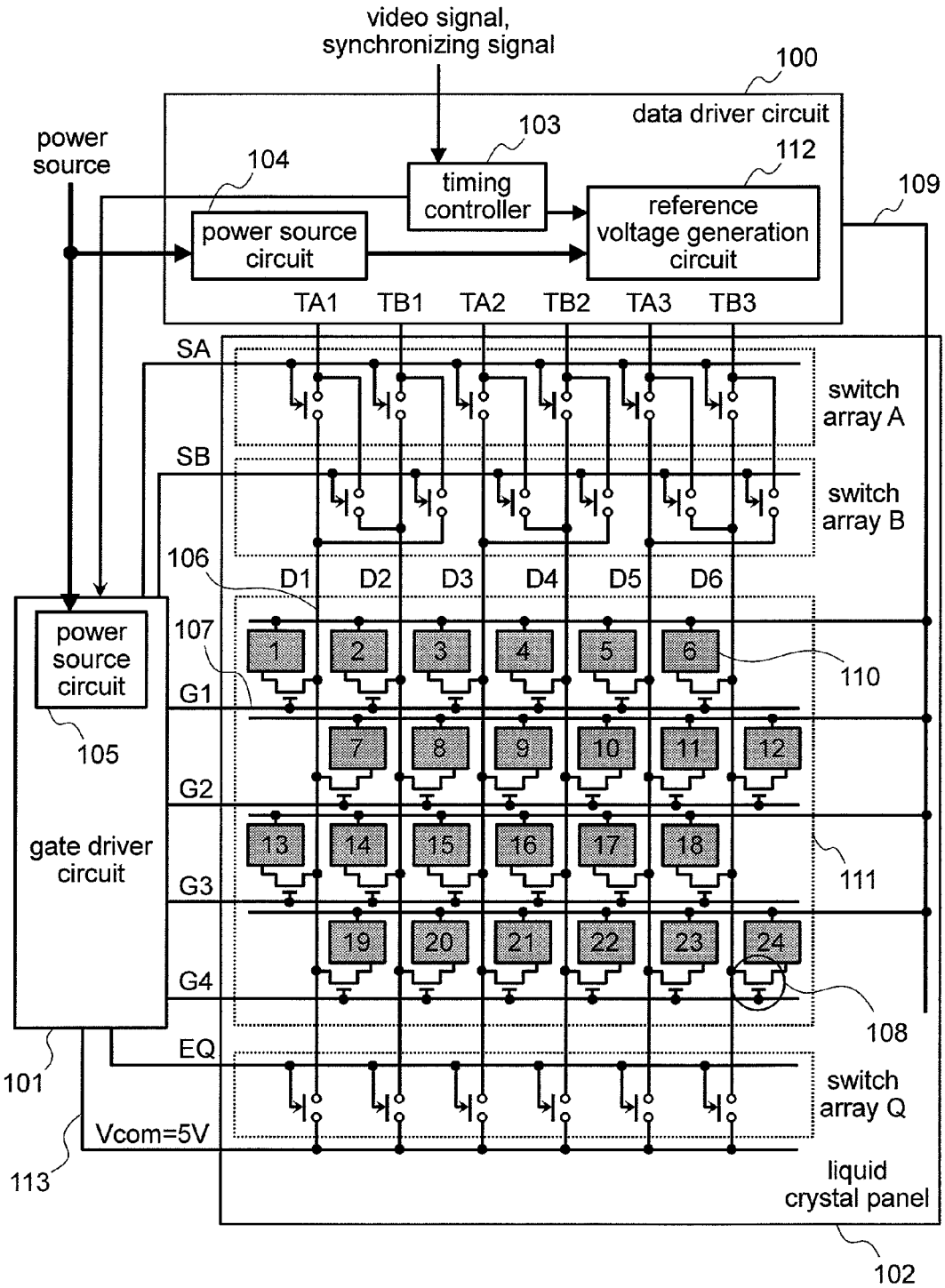
FIG. 1 is a constitutional view of a display device according to the present invention.

FIG. 1 is a constitutional view of a display device according to the present invention. The display device shown in FIG. 1 is constituted of a data driver circuit 100, a gate driver circuit 101, and a liquid crystal panel 102.

The data driver circuit 100 includes, in the inside thereof, a timing controller 103 which generates signals for controlling the data driver circuit 100 and the gate driver circuit 101 and applies digital signal processing to an inputted video signal, a power source circuit (DCDC conversion circuit) 104 which generates a voltage for driving the data driver circuit 100, and a reference voltage generation circuit 112 which generates a data voltage, wherein the data driver circuit 100 outputs the data voltage for driving the liquid crystal panel 102 in response to the inputted video signal.

Next, the gate driver circuit 101 is configured to include, in the inside thereof, a power source circuit 105 which generates voltages Vgh, Vgl for driving the gate driver circuit 101, and outputs a gate voltage for driving the liquid crystal panel 102.

Finally, the liquid crystal panel 102 is configured to include a display region 111 in the inside thereof. An image is displayed on the display region 111 by driving TFTs 108 using data lines 106 connected to the data driver circuit 100, a common line 109 and gate lines 107 connected to the gate driver circuit 101. Further, together with the display region 111, the liquid crystal panel 102 includes a switch array A which can change over polarities of the data lines 106 in response to a control signal SA outputted from the gate driver circuit 101, a switch array B which can change over polarities of the data lines 106 in response to a control signal SB outputted from the gate driver circuit 101, and a switch array Q which can change over polarities of the data lines 106 in response to a control signal EQ outputted from the gate driver circuit 101.

Then, the internal constitution and the manner of operation of the data driver circuit 100 are explained. The data driver circuit 100 has a function of converting the digital video signal inputted thereto from the timing controller 103 into an analogue voltage applied to the liquid crystal pixels 110 and a function of outputting the analogue voltage to the data lines 106 of the liquid crystal panel 102 from an output terminal thereof via an output circuit constituted of an amplifier or the like.

Figure 2:
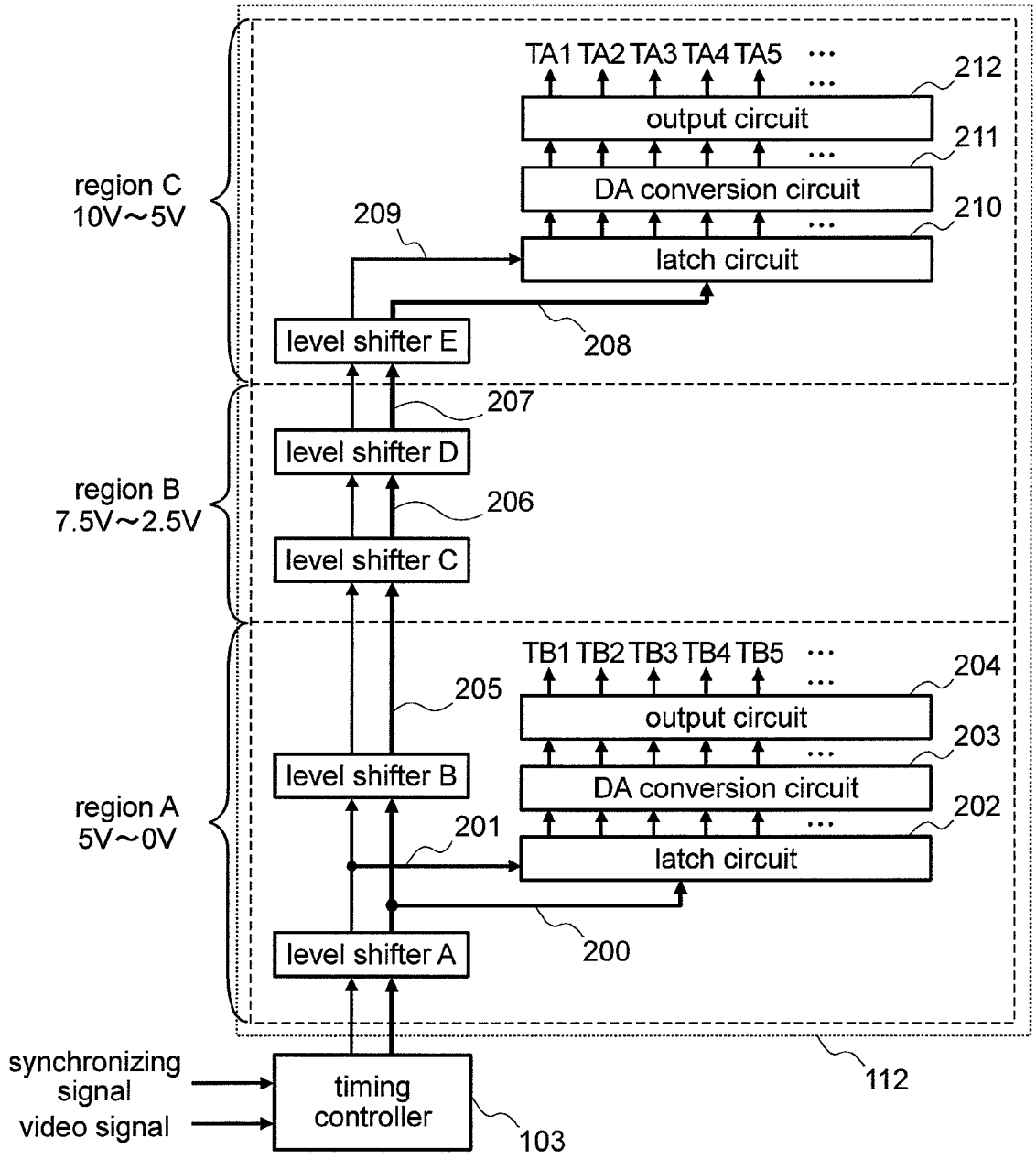
FIG. 2 is an internal constitutional view of a reference voltage generation circuit 112 shown in FIG. 1.

According to the present invention, particularly, for realizing the lowering of a withstand voltage of the data driver circuit 100, as shown in FIG. 2, the output terminal is divided into a first-polarity-use output terminal TA (positive polarity: assuming "VH to Vcom") and a second-polarity-use output terminal TB (negative polarity: assuming "Vcom to VL") thus reducing amplitude of a data line potential.

Hereinafter, VH is defined as 10V, Vcom is defined as 5V, VL is defined as 0V, and a power source voltage is defined as 2.5V. The data driver circuit 100 is, as shown in FIG. 2, divided into a region A treating the potential of 5V to 0V for second polarity, a region C treating the potential of 10V to 5V for first polarity, and a region B treating an intermediate potential 7.5V to 2.5V.

In the data driver circuit 100, first of all, the level of the video signals inputted in series from the timing controller 103 in the region A is shifted to video signals 200 of 5V to 0V level by a level shifter A. Then, the flow is divided into flows for performing processing for first polarity and second polarity and, thereafter, the processing are performed through separate systems until the output terminal.

On the second polarity side, first of all, in response to a latch circuit control signal 201, from the video signals inputted in series out of the video signals 200, the video data amounting to ½ line for second polarity outputting is stored in a latch circuit 202. Then, the digital video signals are collectively converted into analogue data voltages by a DA conversion circuit 203, and the analogue voltages are outputted to the second-polarity-use output terminal TB via an output circuit 204. Here, the level of a signal 201 for controlling the latch circuit 202 is also shifted to a level to 5V to 0V by the level shifter A.

On the other hand, on the first polarity side, the level of the video signal 200 is shifted to the video signal 205 of 5V to 2.5V which falls within the potential treated in the region B by a level shifter B, and is transmitted to the region B. Next, in the region B, the level of the video signal 205 is shifted to a video signal 206 of 7.5V to 2.5V by the level shifter C and, thereafter, the level of the video signal 206 is shifted to a video signal 207 of 7.5V to 5V which falls within the potential treated in the region C by a level shifter D and is transmitted to the region C. Finally, in the region C, the level of the video signal 207 is shifted to a video signal 208 of 10V to 5V which falls within the potential for the first polarity by a level shifter E. Then, in response to a latch circuit control signal 209, from the video signal 208 inputted in series, the video data amounting to ½ line for first polarity outputting is stored in the latch circuit 210. Then, the digital video signals are collectively converted into analogue voltage by a DA conversion circuit 211, and are outputted to the second-polarity-use output terminal TB via the output circuit 212. Here, the level of signals 209 for controlling the latch circuit 210 is also shifted to the potential of 10V to 5V treated in the region C by the level shifter A, the level shifter B, the level shifter C, the level shifter D and the level shifter E.

Figure 3:
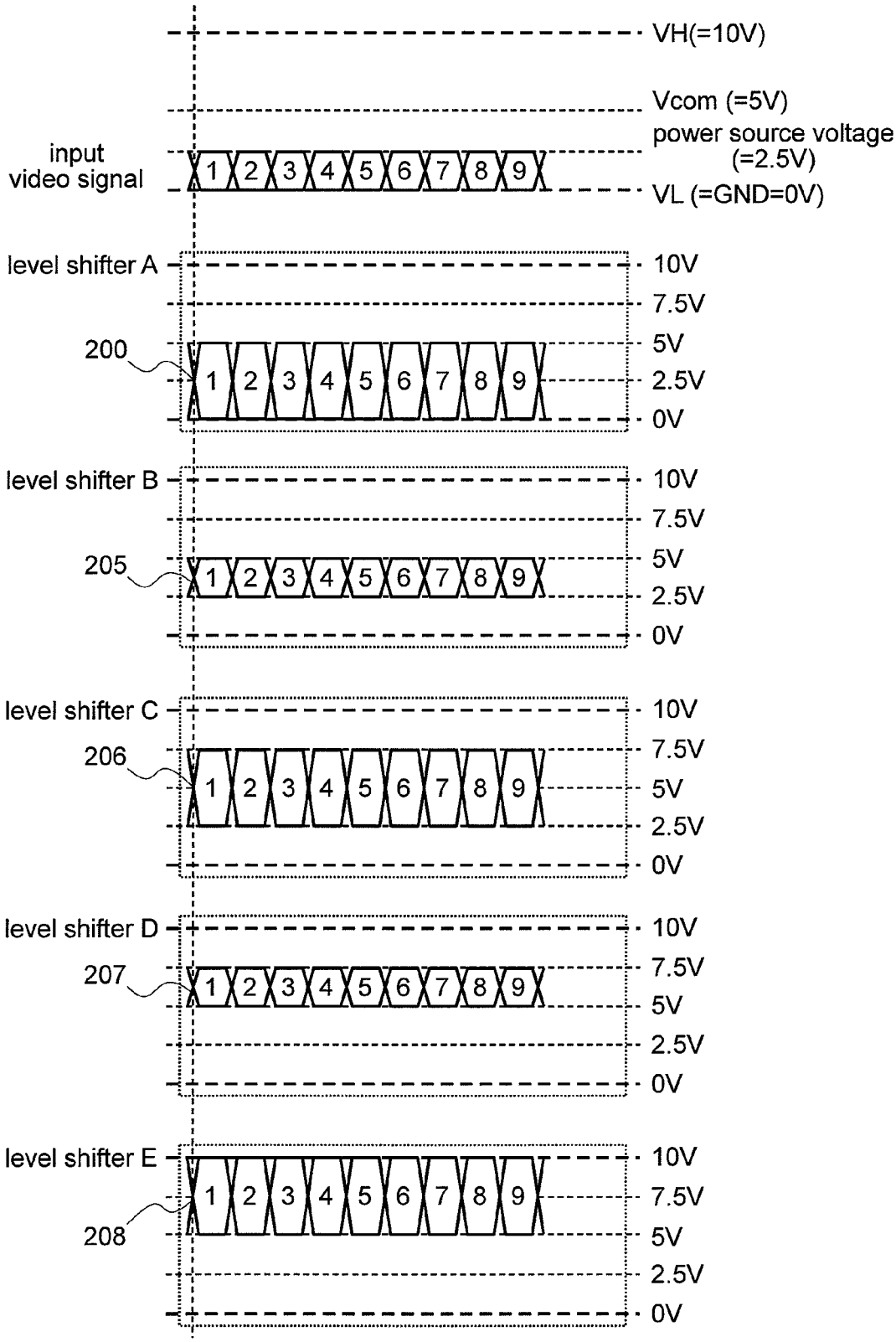
FIG. 3 is a potential transition diagram of a video signal whose level is shifted in FIG. 2.

In this manner, by dividing the data driver circuit into the region A, the region B and the region C and by shifting the level of the inputted video signal to the potential of the first polarity via a plurality of level shifters, it is possible to lower the relative withstand voltages in the respective regions to low withstand voltage of 5V. The transition of the potentials of the level-shifted video signals is shown in FIG. 3.

The power source circuit 104 for supplying the power source to the region A, the region B and the region C besides the video signals is usually required to generate 10V for first polarity from a power source voltage and hence, the power source circuit 104 is required to possess the high withstand voltage of 10V to 0V at maximum. However, according to this embodiment, in the same manner as the video signal, also with respect to the power source circuit 104, by gradually boosting the voltage to 10V from 2.5V through three stages of a booster circuit A, the booster circuit B and the booster circuit C each constituted of a charge pump, a portion which requires a high withstand voltage can be eliminated.

Figure 4:
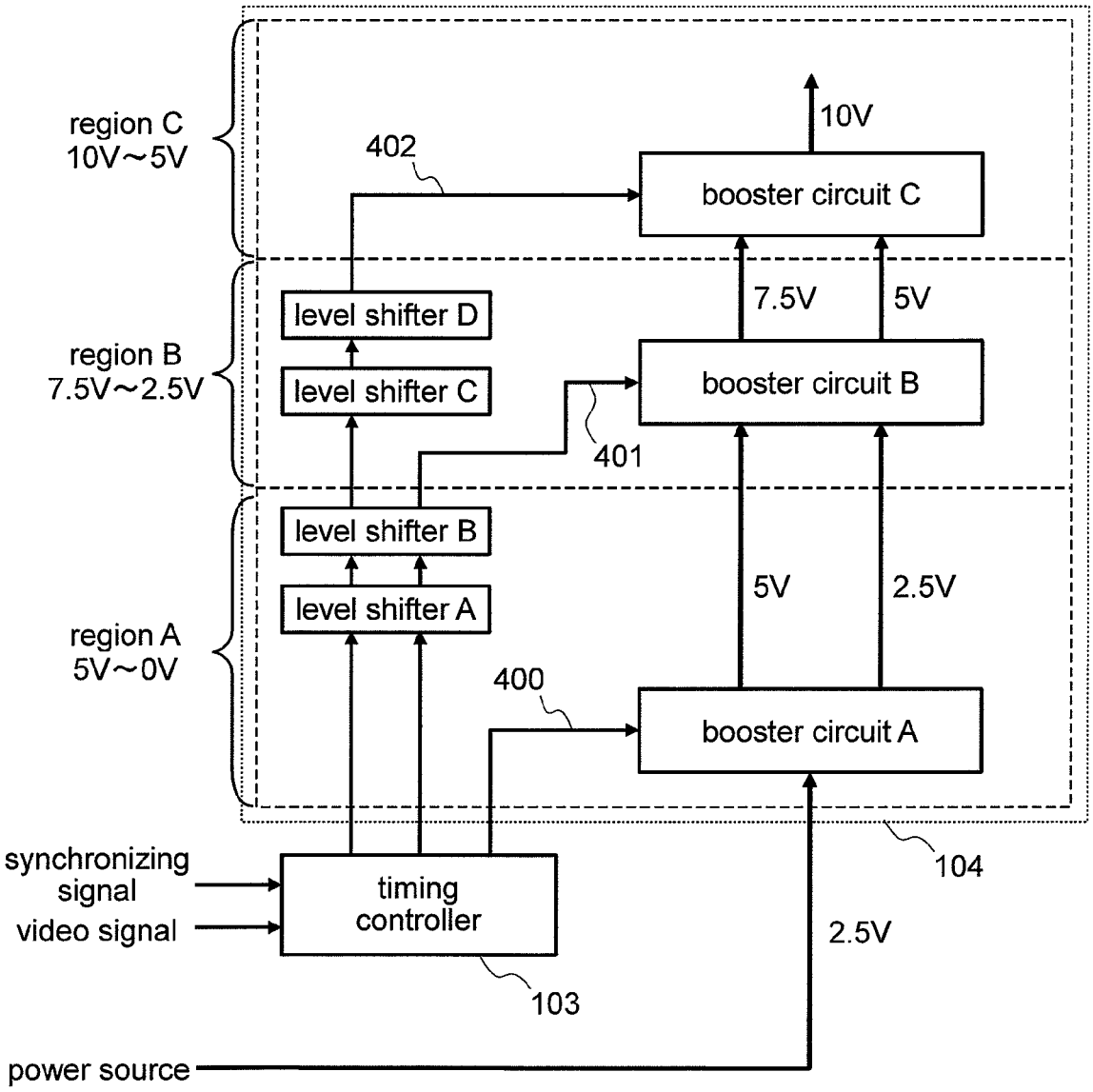
FIG. 4 is an internal constitutional view of a power source circuit shown in FIG. 1.

FIG. 4 shows the internal constitution of the power source circuit 104. The manner of operation of the power source circuit 104 is explained in conjunction with FIG. 4. First of all, the booster circuit A generates 5V based on the inputted power source voltage 2.5V and the booster-circuit-A-use control signal 400. Next, the booster circuit B generates 7.5V based on 5V generated by the booster circuit A and a booster-circuit-B-use control signal 401 using 2.5V as the reference. However, since the booster-circuit-B-use control signal 401 is required to be potential of 7.5V to 2.5V treated in the region B, the level of the potential of the booster-circuit-B-use control signal 401 is shifted via the level shifter A and the level shifter B. Finally, the booster circuit C generates 10V based on 7.5V generated by the booster circuit B and a booster-circuit-C-use control signal 402 using 5V as the reference. However, since the booster-circuit-C-use control signal 402 is required to be the potential of 10V to 5V treated in the region C, the level of the potential of the booster-circuit-C-use control signal 402 is shifted via the level shifter A, the level shifter B, the level shifter C and the level shifter D.

Figure 5:
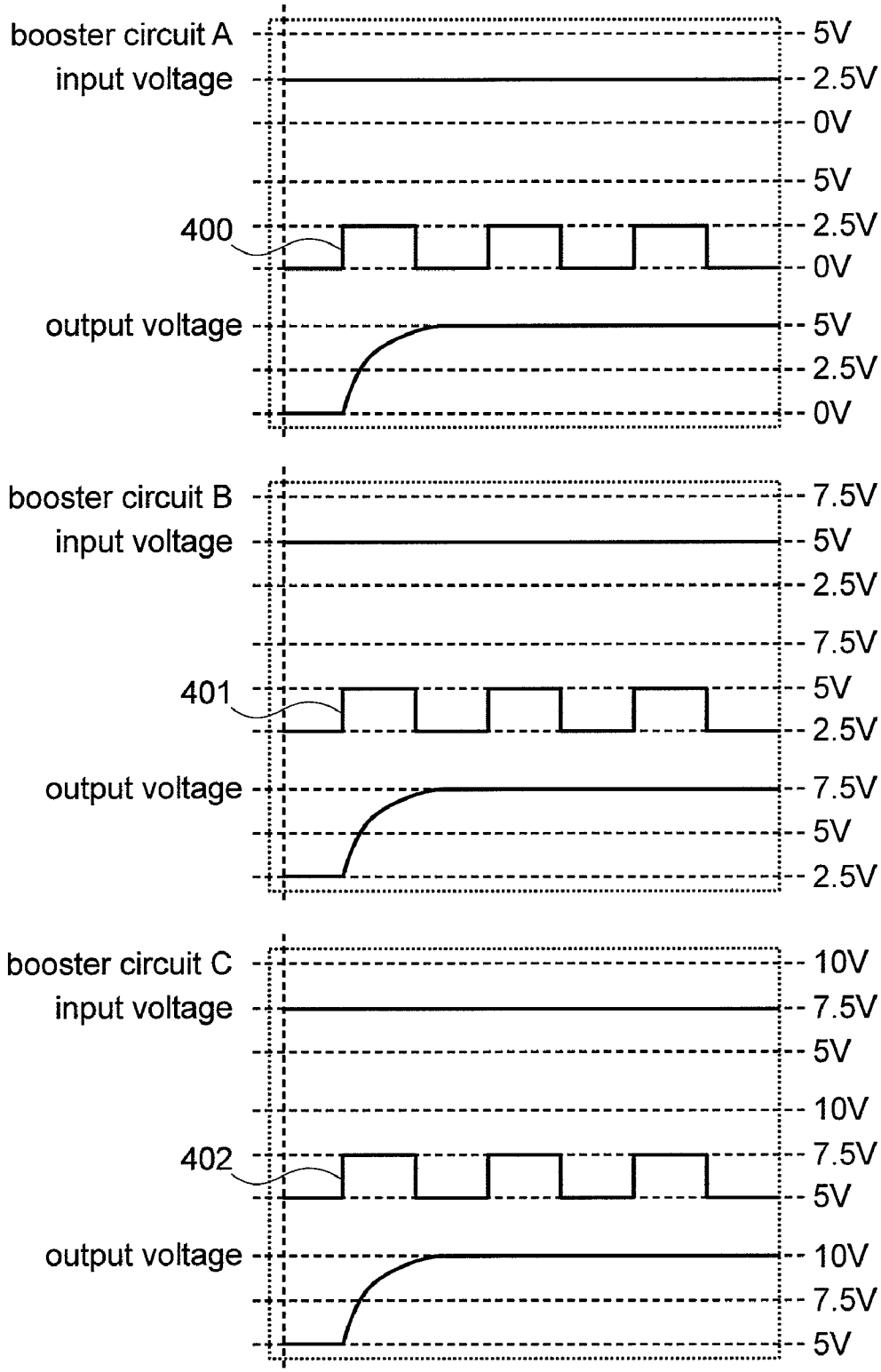
FIG. 5 is a potential transition diagram of a power source voltage whose level is shifted in FIG. 4.

In this manner, in the same manner as level shift of the video signal, in the power source circuit 104, by generating 10V from 2.5V via the plurality of booster circuits, the relative withstand voltages of the power source circuit 104 in the respective regions become 5V of a low withstand voltage. The transition of the power source voltage is shown in FIG. 5.

In this manner, by dividing the data driver circuit 100 into the region A, the region B and the region C, and by level-shifting the video signal and the power source voltage such that the respective regions assume the relative withstand voltage of 5V, the lowering of withstand voltage of the whole data drive circuit 100 can be realized.

Figure 6A:
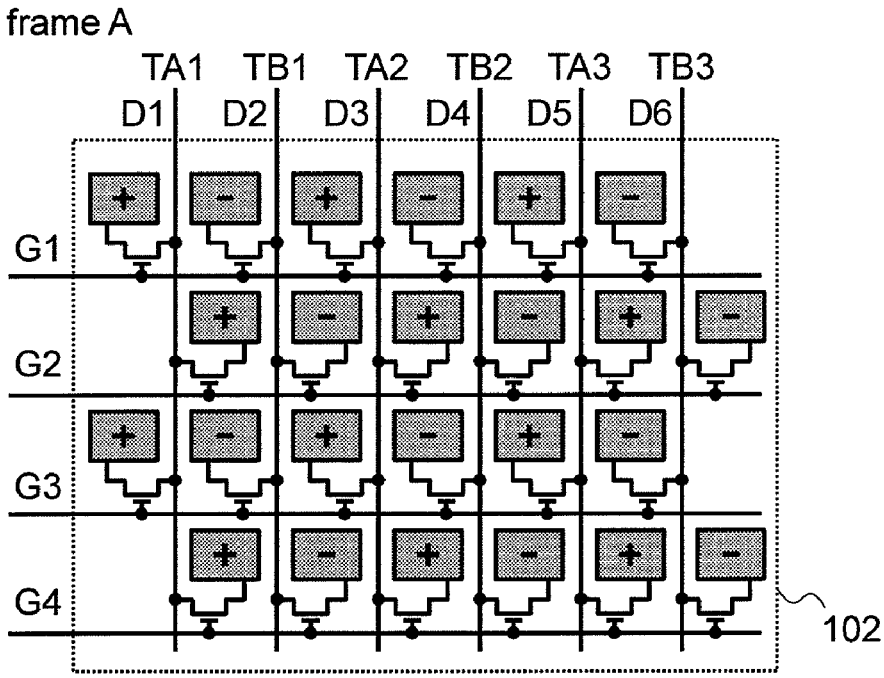
FIG. 6A and FIG. 6B are views showing a change of polarities of liquid crystal pixels shown in FIG. 1.
Figure 6B:
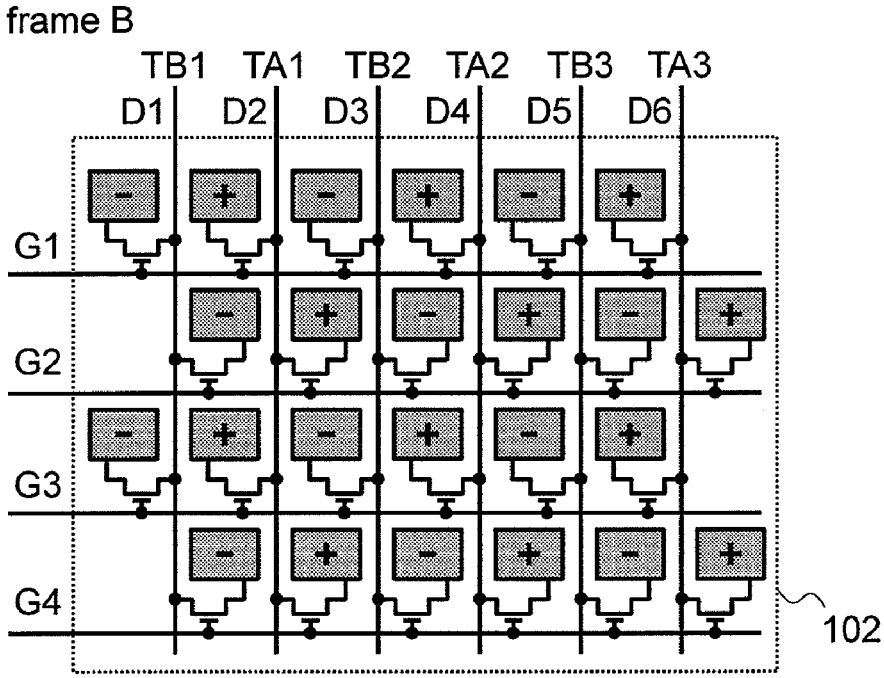

Next, the manner of operation of the liquid crystal panel 102 driven by the data driver circuit 100 is explained. As shown in FIG. 1, the switch array A and the switch array B are constituted of switches for connecting the first-polarity-use output terminals TA and the second-polarity-use output terminals TB of the data driver circuit 100 with the data line 106. By changing over the turning on/off of the switch array A and the switch array B for every 1 frame for preventing the simultaneous turn-on of the switch array A and the switch array B, it is possible to invert the polarities of the liquid crystal pixels between a frame A (a state in which the switch array A is turned on and the switch array B is turned off) shown in FIG. 6A and a frame B (a state in which the switch array A is turned off and the switch array B is turned on) shown in FIG. 6B.

Figure 7:
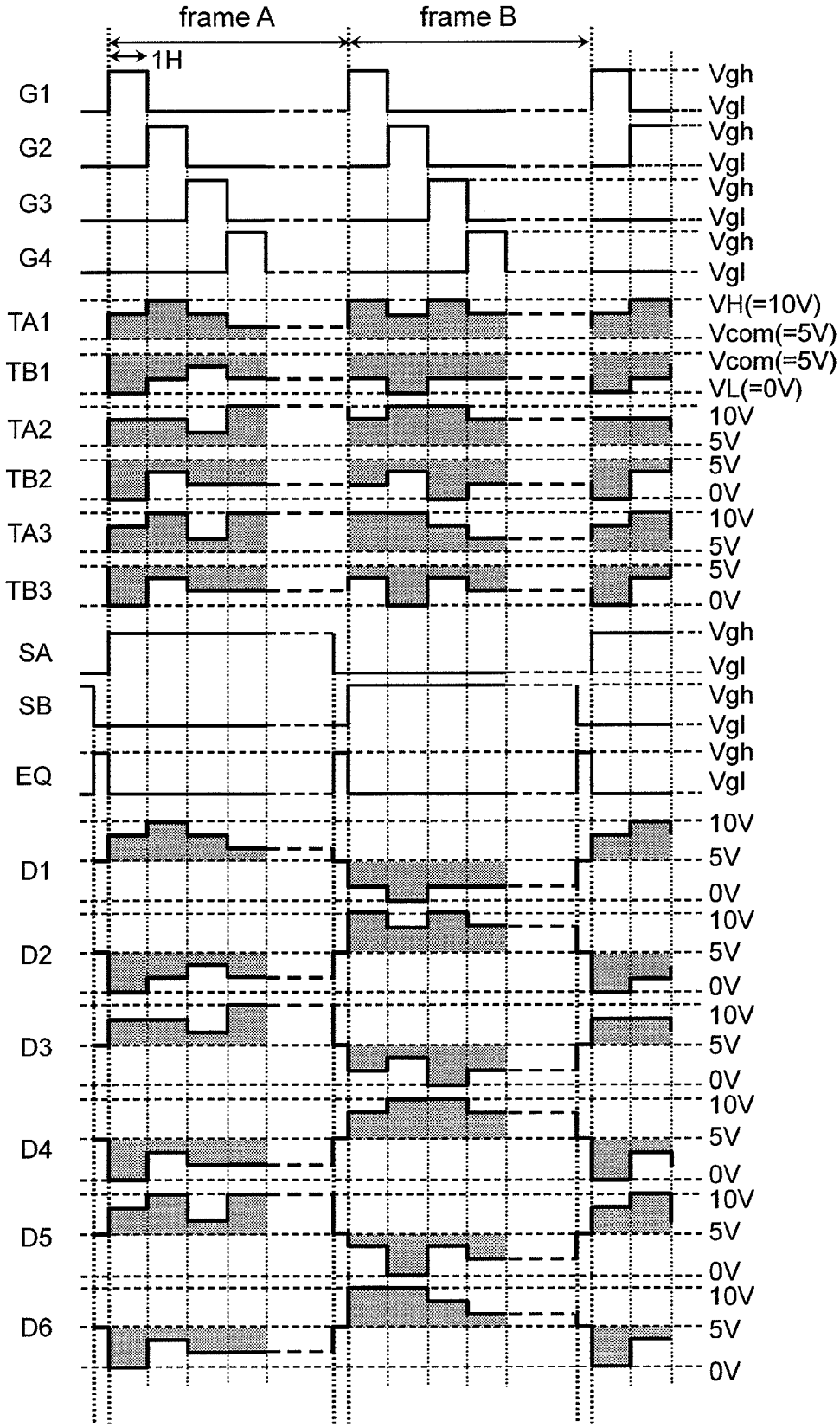
FIG. 7 is a timing chart of a display device shown in FIG. 1.

FIG. 7 is a timing chart of such an operation. To focus on the data line D1 shown in FIG. 7, in the frame A, the switch array A is turned on so that the data line D1 is connected with the first-polarity-use output terminal TA1 and the video signal having the potential of first polarity is outputted to the data line D1. Further, in the frame B, the switch array B is turned on so that the data line D1 is connected with the second-polarity-use output terminal TB1 and the video signal having the potential of second polarity is outputted to the data line D1.

On the other hand, to focus on the data line D2 which constitutes a pair with the data line D1, in the frame A, the switch array A is turned on so that the data line D2 is connected with the second-polarity-use output terminal TB1 and the video signal having the potential of second polarity is outputted to the data line D2. Further, in the frame B, the switch array B is turned on so that the data line D2 is connected with the first-polarity-use output terminal TA1 and the video signal having the potential of first polarity is outputted to the data line D2. By inverting the polarities of the neighboring data lines which constitute the pair, the dot inversion driving can be realized.

However, in inverting the polarities of the data lines 106 by changing over the turn-on/off of the switch array A and the switch array B, due to charges remaining in the first-polarity-use output terminal TA, the second-polarity-use output terminal TB and the data line 106, a potential difference of 10V to 0V at maximum is generated. In view of the above, in inverting the polarities of the data lines 106, both of the switch array A and the switch array B are turned off to bring the data lines 106 and the data driver circuit 100 into a cut-off state. At the same time, the switch array Q is turned on in response to the control signal EQ so that a reset voltage line 113 which supplies 5V having the same potential as the Vcom voltage generated by the gate driver circuit 101 and the data lines 106 are connected with each other and hence, the forced transition of the data lines 106 to the potential of 5V is performed whereby the potential difference can be suppressed to 10V to 5V at maximum at the first-polarity-use output terminal TA and 5V of 5V to 0V at maximum at the second-polarity-use output terminal TB. Accordingly, it is possible to lower the withstand voltages also at the output terminals TA and TB of the data driver circuit 100. Since the gate driver circuit 101 possesses a withstand voltage ranging from Vgh to Vgl having the potential difference larger than 10V to 0V, even when the reset voltage line 113 and the data lines 106 are connected with each other, the withstand voltage of the gate driver circuit 101 is not influenced by the connection.

Further, in the liquid crystal panel 102 shown in FIG. 1, the liquid crystal pixels 110 are arranged in a staggered manner. Accordingly, for example, assuming that the liquid crystal pixels 110 are sub pixels constituting RGB from left and the switch array A is turned on, it is necessary to output the data voltage for R to the liquid crystal pixel 1 on the first line counted from the output terminal TA1 of the data driver circuit 100 and to output the data voltage for G to the liquid crystal pixel 7 on the second line counted from the output terminal TA1 of the data driver circuit 100. In this manner, the data driver circuit 100 is required to perform the changeover of the video signals inputted in series in response to an ON/OFF state of the switch array and the line to which the data voltage is outputted. Such processing is performed by the timing controller 103.

Figure 8:
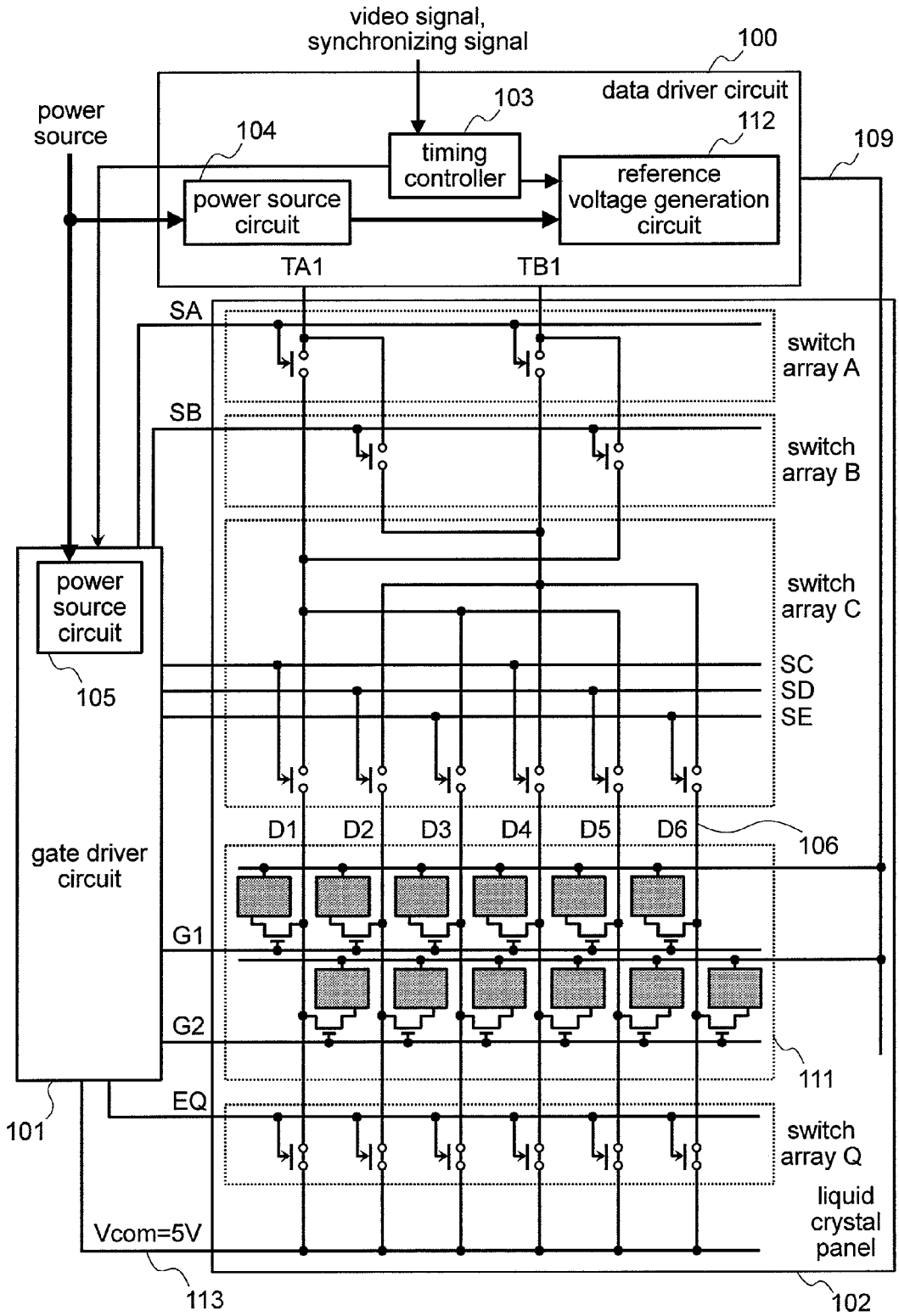
FIG. 8 is a constitutional view of an RGB time-division driving display device.
Figure 9:
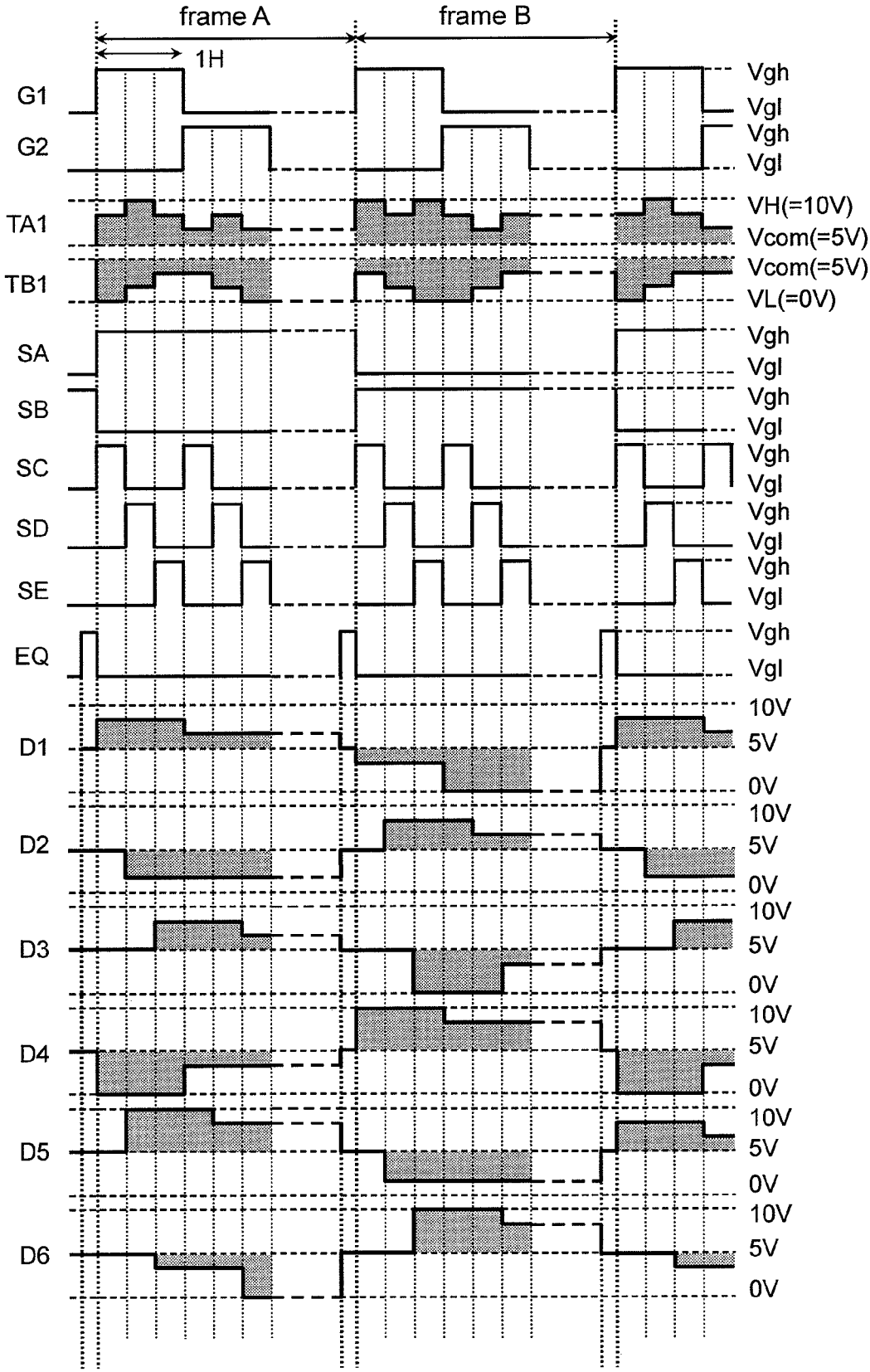
FIG. 9 is a timing chart of the RGB time-division-driving display device shown in FIG. 8.

The liquid crystal panel 102 explained heretofore adopts the structure which allows each output terminal of the data driver circuit 100 to control one data line 106. However, this embodiment may adopt a liquid crystal panel having the structure of 102 shown in FIG. 8 which enables the RGB time-division driving, wherein one output terminal is configured to control a plurality of data lines. In the RGB time-division driving, with use of a switch array A, a switch array B, and a switch array C which can be changed over in response to a control signal SC, a control signal SD and a control signal SE for time division control outputted from the gate driver circuit 101, a data voltage is applied to 6 pieces of data lines 106 from each output terminal of the data driver circuit 100. Although it is necessary to add the switch array C for time division, the manner of operation of the switch array Q is substantially equal to the manner of operation of the switch array Q explained in conjunction with FIG. 7. FIG. 9 is a timing chart used in such an operation. In this manner, the liquid crystal panel 102 which can perform RGB time-division driving can also lower a withstand voltage of the data driver circuit 100.

As described above, this embodiment can realize dot inversion driving with little degradation of image quality using the driver LSI of a low withstand voltage.

Embodiment 2

Figure 10:
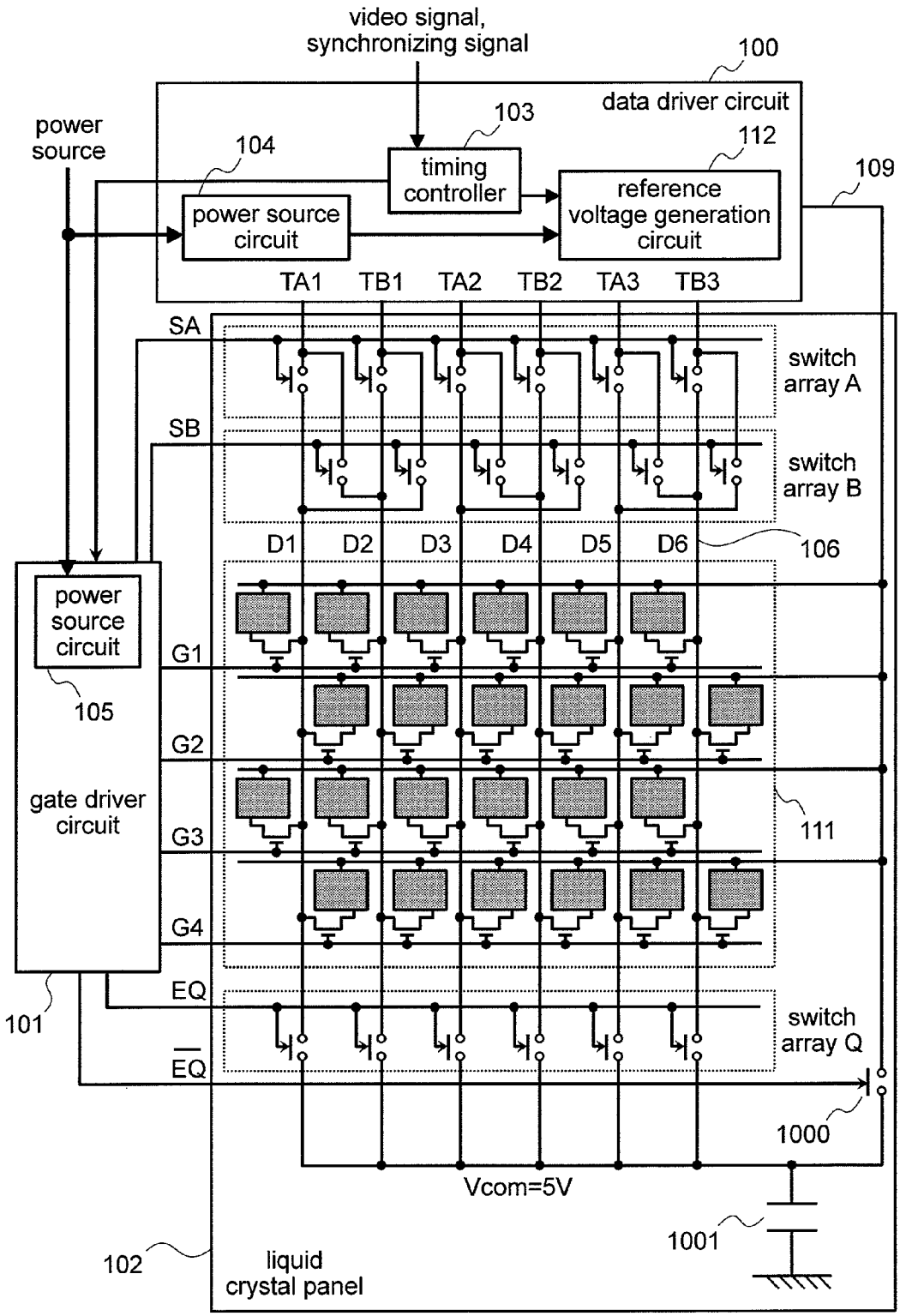
FIG. 10 is another constitutional view of the display device according to the present invention.

FIG. 10 is a constitutional view of a display device of this embodiment. In the embodiment 1, for lowering the withstand voltages of the first-polarity-use output terminal TA and the second-polarity-use output terminal TB of the data driver circuit 100, in inverting the polarities of the data lines 106, the data line 106 is connected with the reset voltage line 113 for supplying 5V equal to the Vcom voltage generated by the gate driver circuit 101.

As in the case of this embodiment, the data lines 106 may be connected with a common line 109 for supplying Vcom (5V) generated by the data driver circuit 100. However, when the data lines 106 and the common line 109 are directly connected with each other, a potential difference of 10V to 0V between the data lines 106 and the common line 109 at maximum is generated at 5V output portions of the common line 109 of the data driver circuit 100 and hence, the data driver circuit 100 is required to possess a high withstand voltage. Accordingly, a switch 1000 is provided to the common line 109, and the switch 1000 is turned off in response to a signal acquired by inverting a control signal EQ generated by the gate driver circuit 101 in connecting the data lines 106 and the common line 109 using the switch array Q and hence, the data lines 106 and the 5V output portion of the common line 109 of the data driver circuit 100 are separated from each other thus realizing the lowering of a withstand voltage of the data driver circuit 100.

Here, it is necessary to maintain the Vcom potential even after the switch 1000 is turned off by providing a capacitor 1001 to a portion where the data lines 106 and the common line 109 are connected with each other. Further, in the same manner as the embodiment 1, during an equalizing operation, both of a switch array A and a switch array B are turned off to cut off the data lines 106 and the data driver circuit 100 from each other.

In this manner, this embodiment can realize the dot inversion driving with little degradation of image quality using the driver LSI of a low withstand voltage.

Embodiment 3

Figure 11:
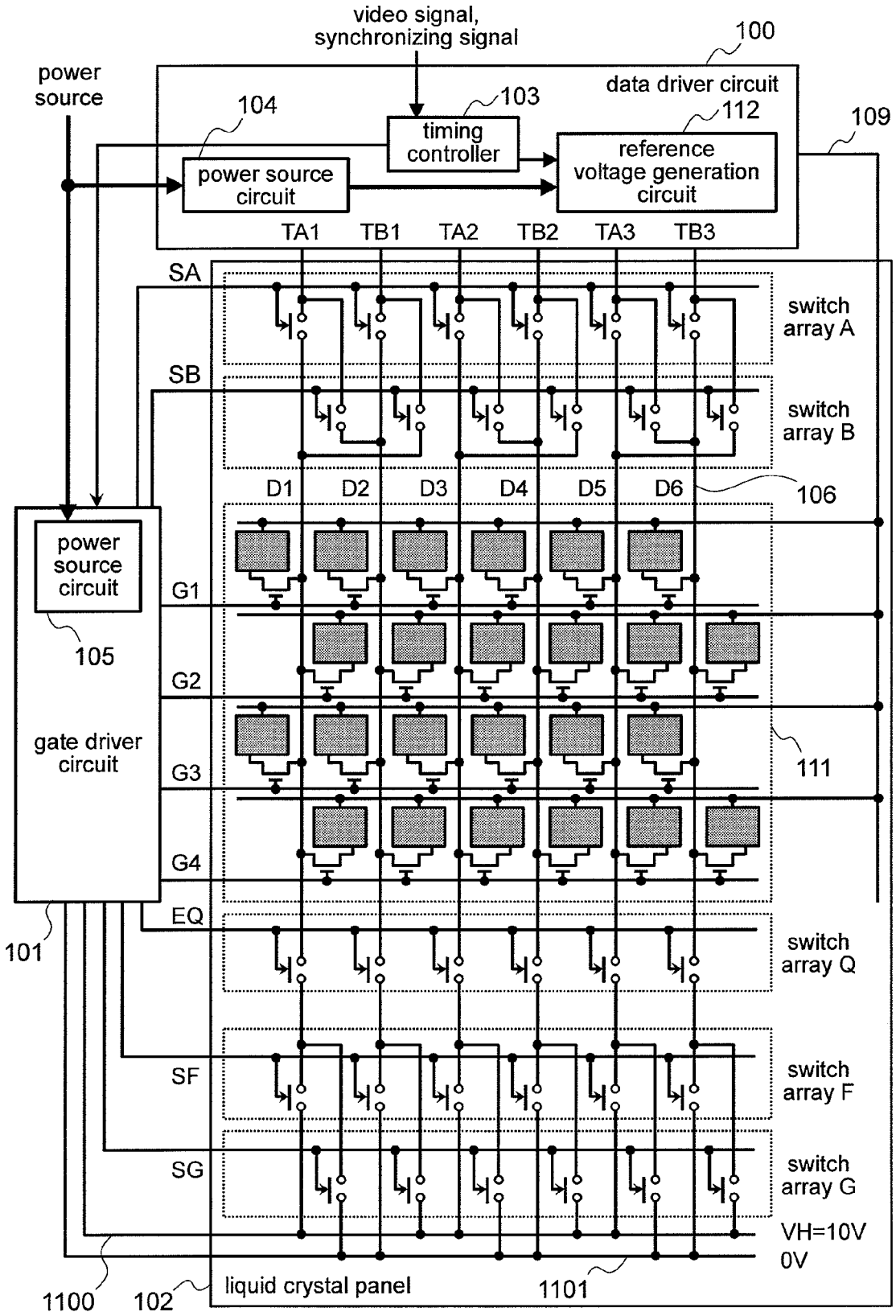
FIG. 11 is another constitutional view of the display device according to the present invention.

FIG. 11 is a constitutional view of a display device of this embodiment. In the embodiment 1 and 2, 5V having the same potential as the Vcom voltage is supplied to the data line 106. However, as in the case of this embodiment, 10V which is a maximum potential on a first polarity side generated by a gate driver circuit 101 and 0V (=GND) which is a minimum potential on a second polarity side may be supplied to data lines 106.

To compare this embodiment with the embodiments 1 and 2, the display device of this embodiment is further provided with a switch array F and a switch array G for selecting the connection destination of the data lines 106, and the respective switch arrays F and G are controlled in response to a switch array control signal SF and a switch array control signal SG outputted from the gate driver circuit 101.

In FIG. 11, when the potential of the data lines 106 is inverted to the second polarity from the first polarity, a reset voltage line 1101 which supplies 0V generated by the gate driver circuit 101 and the data lines 106 are connected with each other, while when the potential of the data lines 106 is inverted to the first polarity from the second polarity, a reset voltage line 1100 which supplies 10V generated by the gate driver circuit 101 and the data lines 106 are connected with each other. Accordingly, a potential difference generated at a first-polarity-use output terminal TA can be suppressed to 10V to 5V at maximum, and a potential difference generated at a second-polarity-use output terminal TB can be suppressed to 5V to 0V at maximum.

Figure 12:
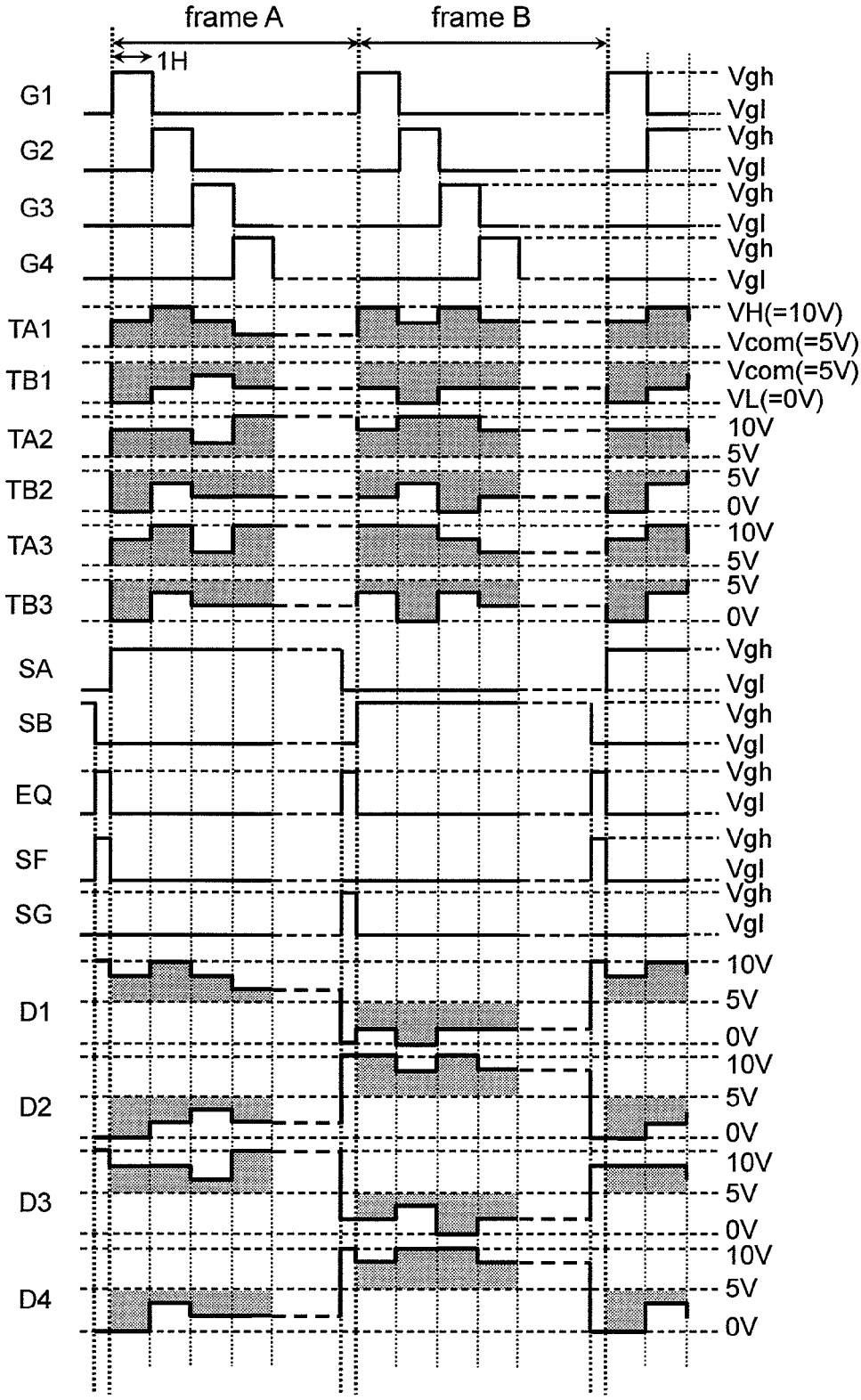
FIG. 12 is a timing chart of the display device shown in FIG. 11.

FIG. 12 is a timing chart of such an operation. To focus on the data line D1 shown in FIG. 12, in the frame A, the switch array A is turned on so that the data line D1 is connected with the first-polarity-use output terminal TA1 and a data voltage having the potential of first polarity is outputted to the data line D1. Next, in the frame B, the switch array B is turned on so that the data line D1 is connected with the second-polarity-use output terminal TB1 and the data voltage having the potential of second polarity is outputted to the data line D1. Then, by connecting the data lines D1 and the reset voltage line 1101 which supplies 0V by turning on the switch array G in inverting the polarity, it is possible to suppress the potential difference generated at the second-polarity-use output terminal TB to 5V to 0V.

On the other hand, to focus on the data line D2 which constitutes a pair with the data line D1, in the frame A, the switch array A is turned on so that the data line D2 is connected with the second-polarity-use output terminal TB1 and a video signal having the potential of second polarity is outputted to the data line D2. Further, in the frame B, the switch array B is turned on so that the data line D2 is connected with the first-polarity-use output terminal TA1 and the video signal having the potential of first polarity is outputted to the data line D2. Then, by connecting the data lines D2 and the reset voltage line 1100 which supplies 10V by turning on the switch array G in inverting the polarity, it is possible to suppress the potential difference generated at the first-polarity-use output terminal TA to 10V to 5V level.

In this manner, the switch array G is turned on when the frame is changed over from frame A to frame B, and the switch array F is turned on when the frame is changed over from the frame B to the frame A. Although this embodiment is explained by taking the case in which the reset voltages are set to 10V and 0V respectively as an example, 10V may be replaced with an arbitrary potential which falls within a range of first polarity and 0V may be replaced with an arbitrary potential which falls within a range of second polarity.

As has been explained heretofore, due to the constitution of this embodiment, even when the reset voltage of 10V or 0V is supplied to the data lines 106, it is possible to realize the dot inversion driving with little degradation of image using the driver LSI of a low withstand voltage in the same manner as a case in which a reset voltage of 5V is applied to the data lines 106.

What is claimed is:

1. A display device comprising:

a data driver circuit which outputs a low-potential-side analog video signal and a high-potential-side analog video signal generated in response to an inputted digital video signal to data lines from an output terminal which outputs the low-potential-side analog video signal and an output terminal which outputs the high-potential-side analog video signal;

a first switch array which changes over the connection between the output terminal of the data driver circuit and the data lines; and a gate driver circuit which generates a gate voltage for sequentially selecting pixels arranged in a staggered manner for every 1 horizontal line and outputs the gate voltage to gate lines, wherein the data driver circuit supplies the analog video signal to the pixels on 1 vertical line among the pixels arranged in a staggered manner from the two neighboring data lines, and the data driver circuit is divided into a first region which generates the low-potential-side analog video signal, a second region which generates the high-potential-side analog video signal and a third region which generates an intermediate potential.

2. A display device according to claim 1, wherein relative withstand voltage of the first, second and third regions are equal to each other.

3. A display device according to claim 1, wherein the first region includes a first booster circuit for boosting a power source voltage supplied from the outside, a first level shifter for converting a level of a video signal to a voltage level of a voltage which the first booster circuit outputs, a second level shifter for converting the level of the video signal from the first level shifter to a voltage level between the voltage which the first booster circuit outputs and the power source voltage supplied from the outside, and a first DA conversion circuit for generating the low-potential-side analog video signal from a video signal which the first level shifter outputs using the voltage which the first booster circuit outputs, the third region includes a second booster circuit for boosting a voltage in response to the voltage which the first booster circuit outputs and the signal which the second level shifter outputs, a third level shifter for converting a level of the signal which the second level shifter outputs to a voltage level between the voltage which the second booster circuit outputs and the power source voltage supplied from the outside, and a fourth level shifter for converting a level of a signal which the third level shifter outputs to a voltage level between a voltage which the second booster circuit outputs and the voltage which the first booster circuit outputs, and the second region includes a third booster circuit for boosting a voltage in response to a signal which the fourth level shifter outputs and the voltage which the second booster circuit outputs, a fifth level shifter circuit for converting a level of a signal which the fourth level shifter outputs to a voltage level between the voltage which the third booster circuit outputs and the voltage which the first booster circuit outputs, and a second DA conversion circuit for generating the high-potential-side analog video signal from a video signal which the fifth level shifter outputs using a voltage which the third booster circuit outputs.

4. A display device according to claim 3, wherein the display device includes a second switch array which supplies a reset voltage for resetting the analog video signal held in the data lines to the data lines.

5. A display device according to claim 4, wherein in allowing the data lines which hold the analog video signal to newly hold the analog video signal having polarity opposite to polarity of the analog video signal held by the data line, a reset voltage is supplied to the data lines via the second switch array before the analog video signal having the opposite polarity is applied to the data lines from the first switch array.

6. A display device according to claim 4, wherein the reset voltage is substantially equal to the voltage which the first booster circuit outputs.

7. A display device according to claim 4 or 5, wherein the reset voltage possesses two potentials, the first reset potential is an arbitrary potential which falls within a range of a voltage outputted by the first DA conversion circuit, the second reset potential is an arbitrary potential which falls within a range of a voltage outputted by the second DA conversion circuit, and the second switch array is configured such that when a potential held by the data lines is changed over from the low-potential-side analog video signal to the high-potential-side analog video signal, the data lines are connected to the second reset potential, and when the potential held by the data lines is changed over from the high-potential-side analog video signal to the low-potential-side analog video signal, the data lines are connected to the first reset potential.

8. A display device according to claim 4, wherein the reset voltage is outputted form the gate driver circuit.

9. A display device according to claim 4, wherein the display device includes a first switch for controlling the connection between an output terminal of the first booster circuit and a capacitor for holding the output voltage of the first booster circuit, and a second switch array for supplying the voltage held by the capacitor to the data lines as the reset voltage, and when the reset voltage is supplied via the second switch array before the analog video signal having the opposite polarity is applied to the data lines from the first switch array, the second switch array is brought into an ON state after the first switch is brought into an OFF state, and when the reset voltage is not supplied, the second switch array is brought into an OFF state and the first switch is brought into an ON state.

* * * * *